US007966676B2

(12) United States Patent
Ueno et al.

(10) Patent No.: US 7,966,676 B2
(45) Date of Patent: Jun. 28, 2011

(54) TOILET BOWL FLUSHING WATER TANK DEVICE

(75) Inventors: Yoichiro Ueno, Kitakyusyu (JP); Eiji Fukuzawa, Kitakyusyu (JP); Haruki Matsuda, Kitakyusyu (JP); Yukihiro Muroya, Kitakyusyu (JP)

(73) Assignee: Toto Ltd., Kitakyusyu-Shi (JP)

( * ) Notice: Subject to any disclaimer, the term of this patent is extended or adjusted under 35 U.S.C. 154(b) by 550 days.

(21) Appl. No.: 12/071,781

(22) Filed: Feb. 26, 2008

(65) Prior Publication Data

US 2008/0201835 A1 Aug. 28, 2008

(30) Foreign Application Priority Data

Feb. 28, 2007 (JP) ..... 2007-049833

(51) Int. Cl.
*E03D 5/09* (2006.01)

(52) U.S. Cl. ..... 4/410; 4/391; 4/413; 4/414; 4/405

(58) Field of Classification Search ..... 4/410, 413, 4/414, 390, 391, 405, 366, 382, 383
See application file for complete search history.

(56) References Cited

U.S. PATENT DOCUMENTS

| | | | | |
|---|---|---|---|---|
| 2,436,679 | A * | 2/1948 | Sprague | 4/410 |
| 6,691,332 | B2 * | 2/2004 | Khoo | 4/325 |
| 7,100,218 | B2 * | 9/2006 | Wooldridge et al. | 4/405 |
| 2006/0130224 | A1 | 6/2006 | Wooldridge et al. | |

FOREIGN PATENT DOCUMENTS

| | | |
|---|---|---|
| CN | 2436572 Y | 6/2001 |
| JP | A-52-69841 | 5/1977 |

OTHER PUBLICATIONS

Aug. 14, 2009 Office Action issued in Chinese Patent Application No. 2008100083403 (with translation).

* cited by examiner

*Primary Examiner* — Gregory L Huson
*Assistant Examiner* — Lauren Heitzer
(74) *Attorney, Agent, or Firm* — Oliff & Berridge, PLC

(57) ABSTRACT

The present invention provides a toilet bowl flushing water tank device which can largely open a discharge valve element instantaneously and, at the same time, can ensure a relatively large space in the vicinity of a discharge valve device thus enhancing a discharge capacity with a small power. A push button mounted on a tank lid body of a flushing water tank body is arranged at a position offset to one side from a position where a discharge opening is formed, a leverage device is constituted of a lever which is interlockingly connected to the discharge valve element and a pedestal which pivotally supports a middle portion of the lever. The pedestal pivotally supports a middle portion of the lever at a position closer to a push button side than the discharge valve device.

8 Claims, 5 Drawing Sheets

TOILET BOWL FLUSHING WATER TANK DEVICE

BACKGROUND OF THE INVENTION

1. Field of the Invention

The present invention relates to a toilet bowl flushing water tank device which can largely operate a discharge valve element with an operation of a push bottom for discharging water by way of a leverage device.

2. Background Art

Conventionally, as a toilet bowl flushing water tank device, as described in patent document 1 (JP-UM-A-52(1977) 69841), there has been known a toilet bowl flushing water tank device which houses, in a flushing water tank, a discharge valve device capable of performing a valve opening/closing operation by moving a discharge valve element in the vertical direction relative to a discharge opening, and a leverage device interposed between the discharge valve device and a discharge push button formed on a tank lid body.

The leverage device mounted on the conventional toilet bowl flushing water tank device is constituted of a pedestal arranged between a discharge valve element device and a push button, and a lever which is pivotally supported on an upper end of the pedestal and has one end thereof interlockingly connected to the push button and the other end thereof interlockingly connected to a discharge valve element. When the push button is pushed, the lever is rotated about a pivotally supporting point at which the lever and the pedestal are connected with each other. As a result, one end of the lever on a push-button side which constitutes a power point is pushed and rotated downwardly, while the other end of the lever on a side of the discharge valve element side which constitutes a point of action is rotated upwardly. Accordingly, the discharge valve element is pulled up to open a discharge opening thus enabling discharging of flushing water.

SUMMARY OF THE INVENTION

However, in the leverage device mounted on the conventional toilet bowl flushing water tank device, the pivotally supporting point at which the lever and the pedestal are connected with each other is arranged at a position closer to the discharge valve device than the push button and hence, a distance from the pivotally supporting point to the point of action is shorter than a distance from the pivotally supporting point to the power point. Accordingly, even when the push button is pushed, a pull-up quantity of the discharge valve element is limited to a relatively small value. Further, a space defined between the discharge valve device and the leverage device is small and hence, it is inevitably necessary to set a diameter of the discharge opening to a relatively small value whereby an instantaneous discharge quantity is decreased thus lowering a discharge capacity.

On the other hand, recently, from a viewpoint of effectively utilizing a toilet space or enhancing the design of the toilet space, it is often necessary to suppress a height of the toilet bowl flushing water tank device as low as possible. In this case, a water level of flushing water stored in a flushing water tank is lowered thus decreasing a head pressure of water. Accordingly, when the above-mentioned conventional leverage device is used, the pull-up quantity of the discharge valve element and a diameter of the discharge opening are limited and hence, a force of water of the flushing water supplied to the toilet bowl is decreased thus giving rise to a drawback that a desired discharge capacity can not be ensured.

Accordingly, it is an object of the present invention to provide a toilet bowl flushing water tank device which can largely open a discharge valve element instantaneously and, at the same time, can ensure a relatively large space in the vicinity of a discharge valve device thus enhancing a discharge capacity with small power.

To achieve the above-mentioned object, the invention described in claim 1 is characterized in that in a toilet bowl flushing water tank device which includes: a flushing water tank body forming a discharge opening in a center portion thereof; a discharge valve device for vertically moving a discharge valve element relative to the discharge opening, the discharge valve device being mounted and housed in the flushing water tank body, a leverage device being interlockingly connected to the discharge valve device, the leverage device being mounted and housed in the flushing water tank body, and a push button being interlockingly connected to the leverage device in the flushing water tank body, the push button being mounted on a tank lid body of the flushing water tank body, the push button is configured to be arranged at a position offset to one side from a position where the discharge opening is formed, the leverage device is constituted of a lever which is interlockingly connected to the discharge valve element and a pedestal which pivotally supports a middle portion of the lever, and the pedestal pivotally supports a middle portion of the lever at a position closer to a push button side than the discharge valve device.

Further, the invention described in claim 2 is characterized in that a height adjusting mechanism is arranged below the pedestal of the leverage device.

Further, the invention described in claim 3 is characterized in that a three-way leg body constituted of left and right branch leg bodies and a center-back leg body is contiguously mounted on a lower end of the pedestal of the leverage device.

Further, the invention described in claim 4 is characterized in that the height adjusting mechanism is constituted of an adjusting block which is detachably mounted on the three-way leg body for adjusting a distance between ground contact surfaces of the three-way leg body and an inner bottom surface of the flushing water tank body.

Further, the invention described in claim 5 is characterized in that a lever receiving portion which receives a pushing action of the push button is formed on the lever of the leverage device and the lever receiving portion is configured such that a vertical mounting position of the lever receiving portion is adjustable relative to the lever by way of adjusting washers.

Further, the invention described in claim 6 is characterized in that a pedestal stay for connecting a lower portion of a casing of the discharge valve device and a lower portion of the pedestal of the leverage device has one end thereof configured to be detachably fitted in the lower portion of the casing and has another end thereof provided with an upright support shaft fitted in an insertional hole formed in a lower end of the pedestal in an erected manner, and the support shaft is fitted in and fixed to the insertional hole in a tiltable manner by a predetermined length in the vertical direction.

Further, the invention described in claim 7 is characterized in that a pedestal stay for connecting a lower portion of a casing of the discharge valve device and a lower portion of the pedestal of the leverage device has one end thereof configured to be detachably fitted in the lower portion of the casing and has another end thereof provided with an upright support shaft fitted in an insertional hole formed in a lower end of the pedestal, and the support shaft is loosely fitted in the insertional hole with a predetermined gap between the support shaft and an inner peripheral surface of the insertional hole.

THE EFFECT OF THE INVENTION

According to the invention described in claim 1, the push button is configured to be arranged at the position offset to one side from the position where the discharge opening is formed, the leverage device is constituted of the lever interlockingly connected to the discharge valve element and the pedestal pivotally supporting the middle portion of the lever, and the pedestal pivotally supports the middle portion of the lever at the position closer to the push button side than the discharge valve device. Due to such a constitution, using the pivotally supporting portion of the lever as the center, the distance between the pivotally supporting portion of the lever and the point of action of the lever is set larger than the distance between the pivotally supporting portion of the lever and the power point in leverage device of the lever. Accordingly, one end of the lever which constitutes the point of action can be largely operated with a small push-down quantity (stroke) of the push button thus lifting an overflow pipe at a stroke and hence, it is possible to largely open the discharge valve element instantaneously and, at the same time, it is possible to ensure a relatively large space in the vicinity of the discharge valve device thus allowing the discharge opening to have a relatively large diameter.

According to the invention described in claim 2, the height adjusting mechanism is arranged below the pedestal of the leverage device and hence, it is possible to adjust a gap defined between the lower end portion of the pedestal and the inner bottom surface of the flushing water tank body. Eventually, by adjusting gaps between the respective leg bodies of the three-way leg body and a un-uniform level of inner bottom surface, a height balance between three leg bodies is adjusted thus enabling the three-way leg body to absorb a play of the three-way leg body and, at the same time, it is possible to perform the fine adjustment of a height of the pedestal as a whole.

According to the invention described in claim 3, the three-way leg body constituted of the left and right branch leg bodies and the center-back leg body is contiguously mounted on the lower end of the pedestal of the leverage device and hence, it is possible to acquire an advantageous effect that the stability of the leverage device can be ensured with the use of the simple structure.

According to the invention described in claim 4, the height adjusting mechanism is constituted of the adjusting block which is detachably mounted on the three-way leg body for adjusting the distance between ground contact surfaces of the three-way leg body and the inner bottom surface of the flushing water tank body. Due to such a constitution, by making thicknesses of respective side walls of the hollow rectangular frame of the adjusting block different from each other, it is possible to adjust gaps defined between mounting portions of the three-way leg body and the inner bottom surface of the flushing water tank body by selecting the thicknesses of the side walls thus absorbing the play of the three-way leg body and hence, it is also possible to perform the fine adjustment of the height of the pedestal as a whole.

Further, according to the invention described in claim 5, the lever receiving portion which receives a pushing action of the push button is formed on the lever of the leverage device and the lever receiving portion is configured such that the vertical mounting portion of the lever receiving portion is adjustable relative to the lever by way of the adjusting washer and hence, it is impossible to acquire an advantageous effect that a relative positional relationship between the push button and the lever receiving portion can be easily adjusted whereby it is possible to easily adjust timing at which the push button is brought into contact with the lever receiving portion.

According to the invention described in claim 6, the pedestal stay for connecting the lower portion of the casing of the discharge valve device and the lower portion of the pedestal of the leverage device has one end thereof configured to be detachably fitted in the lower portion of the casing and has another end thereof provided with the upright support shaft which is fitted in the insertional hole formed in the lower end of the pedestal, and the support shaft is fitted in and fixed to the insertional hole in a movable manner by a predetermined length in the vertical direction and hence, it is possible to acquire an advantageous effect that an error in the vertical direction which occurs attributed to the setting of the position of the pedestal in the vertical direction can be absorbed.

According to the invention described in claim 7, the pedestal stay for connecting the lower portion of the casing of the discharge valve device and the lower portion of the pedestal of the leverage device has one end thereof configured to be detachably fitted in the lower portion of the casing and has another end thereof provided with the upright support shaft which is fitted in the insertional hole formed in the lower end of the pedestal, and the support shaft is loosely fitted in the insertional hole with a predetermined gap between the support shaft and the inner peripheral surface of the insertional hole. Accordingly, it is possible to acquire an advantageous effect, even when the pedestal stay is arranged in an inclined state in performing the setting of the vertical position of the pedestal, it is possible to absorb the inclination of the pedestal stay due to the presence of the gap.

DETAIL DESCRIPTION OF THE EMBODIMENTS

Figure 1:
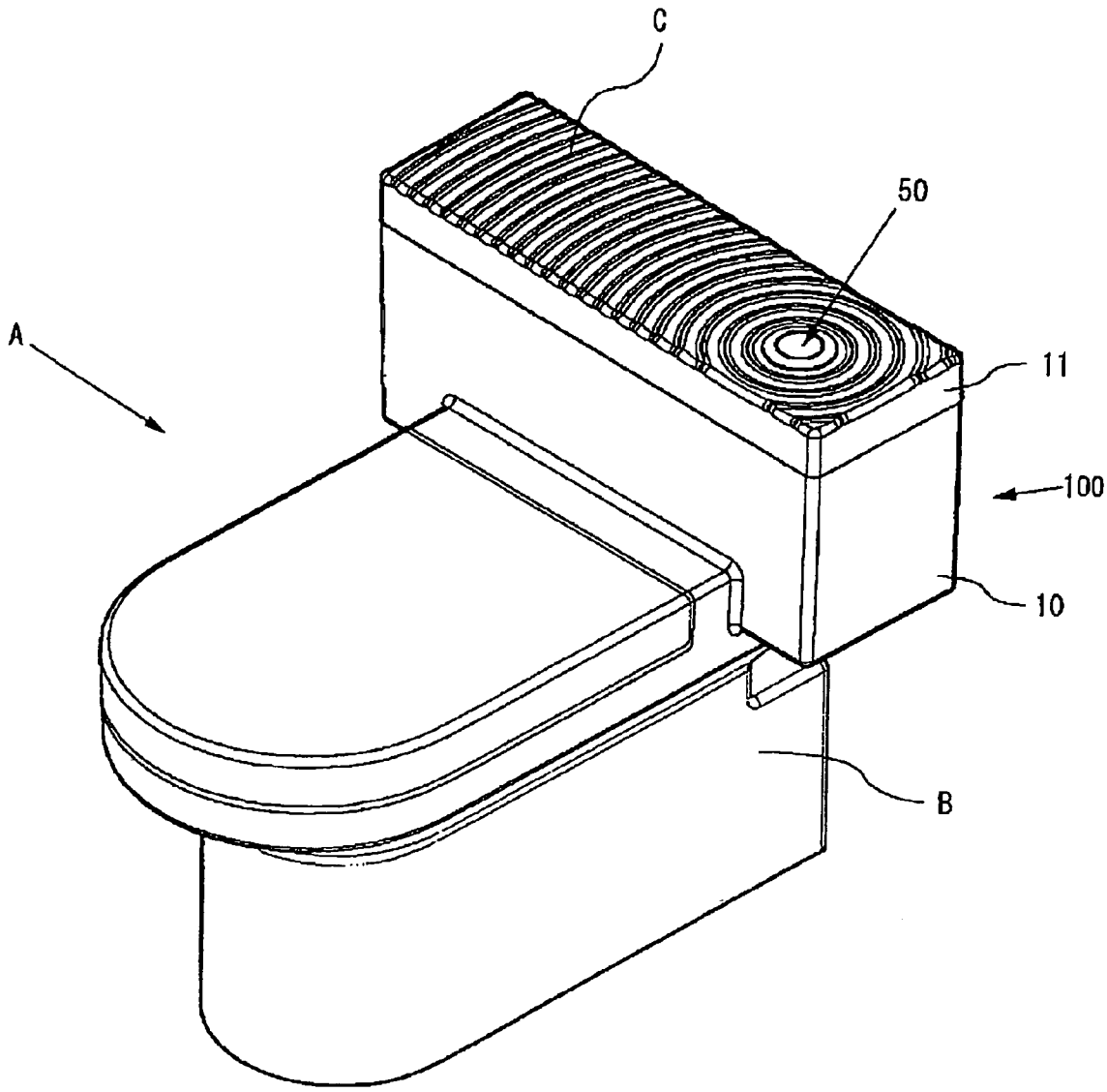
FIG. 1 is a perspective view showing the schematic constitution of a toilet bowl provided with a toilet bowl flushing water tank device to which the present invention is applied.

Hereinafter, an embodiment of the present invention is explained in conjunction with drawings. FIG. 1 is a perspective view showing the schematic constitution of a toilet having a toilet bowl flushing water tank device 100, FIG. 2 is a cross-sectional front view showing a state before a discharge operation using the toilet bowl flushing water tank device 100, and FIG. 3 is a cross-sectional front view showing a state during the discharge operation of the toilet bowl flushing water tank device 100 shown in FIG. 1.

Figure 2:
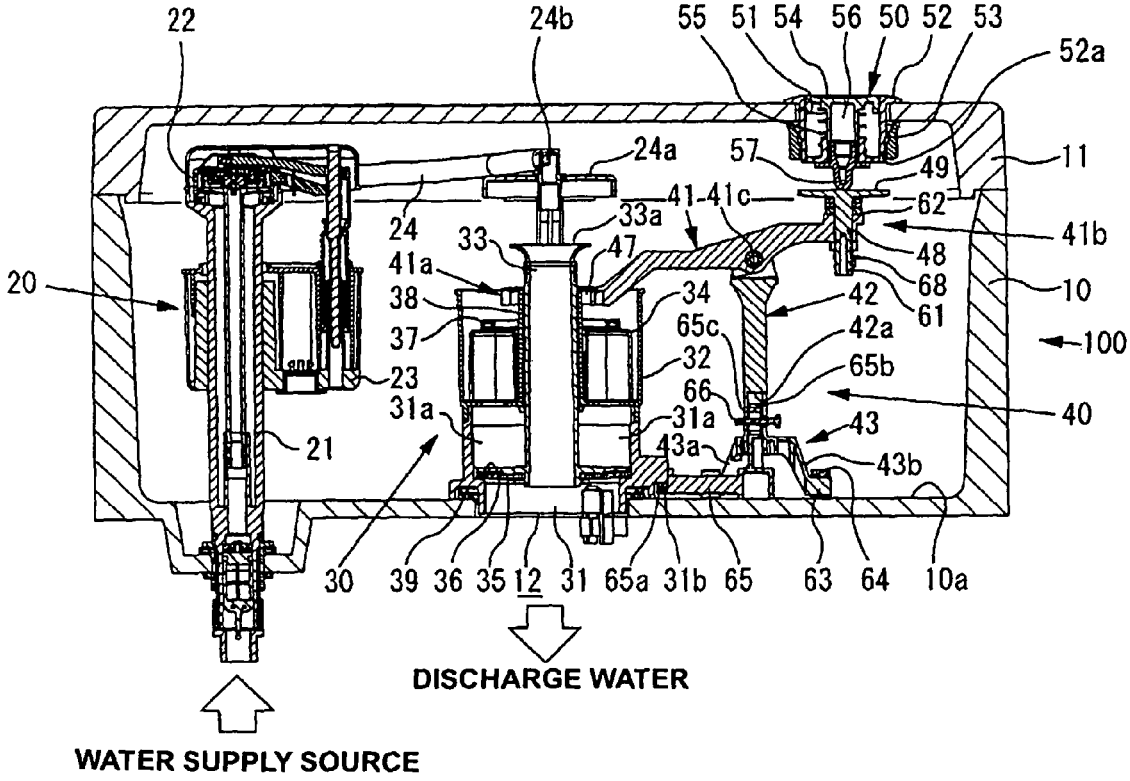
FIG. 2 is a cross-sectional front view showing a state of the toilet bowl flushing water tank device shown in FIG. 1 before a discharge operation is performed.
Figure 3:
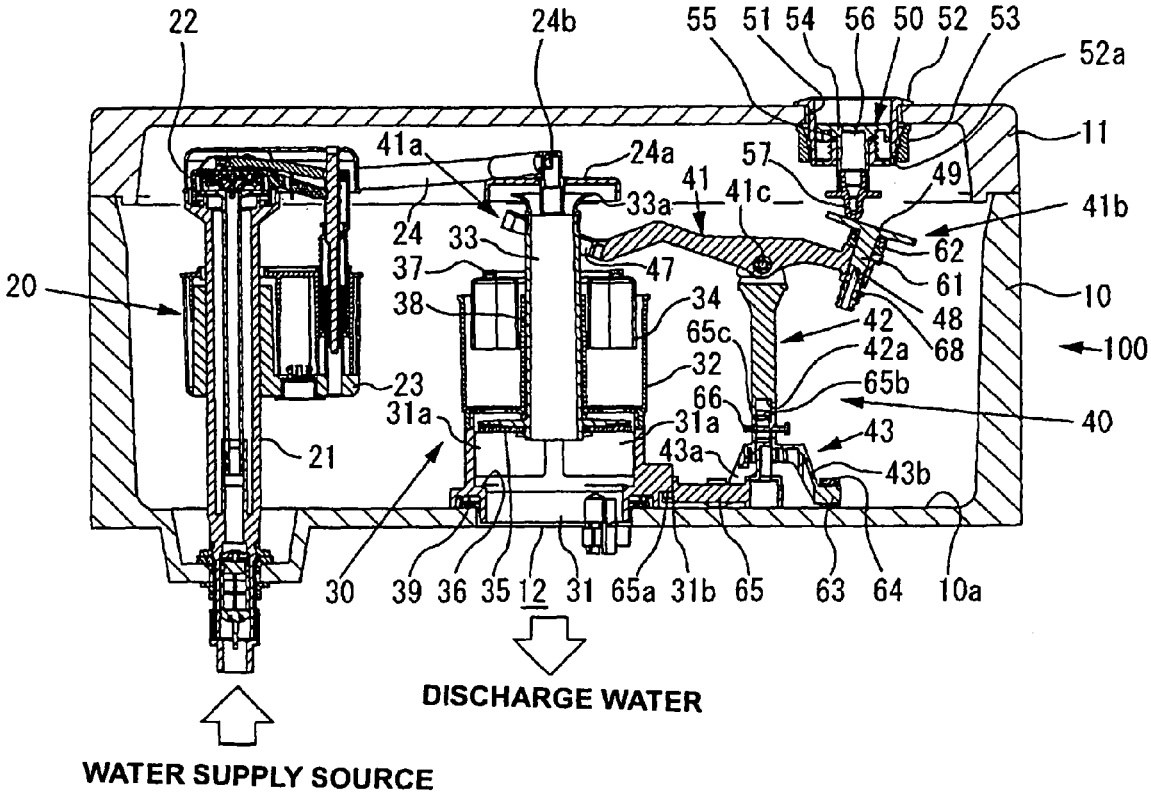
FIG. 3 is a cross-sectional front view showing a state of the toilet bowl flushing water tank device shown in FIG. 1 at the time of performing the discharge operation.

As shown in FIG. 1 to FIG. 3, the toilet bowl flushing water tank device 100 of the present invention is mounted on a back surface of a toilet body B of the toilet A to supply flushing water to the toilet body B. The toilet bowl flushing water tank device 100 includes a flushing water tank body 10 which stores flushing water to be supplied to the toilet A, a water supply device 20 which is housed in the flushing water tank body 10 for supplying water to the tank body 10, a discharge valve device 30 which is housed in the flushing water tank body 10 for discharging flushing water stored in the tank body 10 to the toilet A, a leverage device 40 which is housed in the flushing water tank body 10 and is interlockingly connected to the discharge valve device 30, and a push button 50 which is arranged on a right-side portion of a tank lid body 11 and is interlockingly connected to the leverage device 40. In FIG. 1, symbol C indicates a wavelike pattern applied to an upper surface of the tank lid body 11 of the flushing water tank body.

The flushing water tank 10 is formed in an approximately planar box shape for storing water supplied from a water supply source (not shown in the drawing) and for discharging the flushing water to the toilet body B. Further, a discharge opening 12 is formed in a center portion of an inner bottom surface 10*a* of the tank body 10, an upper opening portion of the flushing water tank 10 is covered with the tank lid body 11 in an openable manner, and the push button 50 is arranged at a right-side portion of the tank lid body 11. That is, the push button 50 is arranged at a position offset to one side from a position where the discharge opening 12 is formed.

Further, in the flushing water tank body 10, the water supply device 20 for supplying water into the inside of the tank body 10 is housed. The water supply device 20 is arranged upright in a left-side portion of the inside of the flushing water tank body 10. The water supply device 20 includes a water supply pipe 21 which is connected to a water supply source at a lower end thereof, a water supply valve 22 which is arranged on an upper end of the water supply pipe 21 for changing over supplying water to the flushing water tank body 10 and stopping such supply of water, a float portion 23 which is provided for changing over operations of the water supply valve 22 such as discharging and stopping of water by a vertical motion thereof in response to the water-level changing in the flush water tank body 10, and a discharge pipe (not shown in drawings) which discharges water from the water supply valve 22. Further, a joint 24*b* is attached to a distal end portion of a refill pipe 24 extending from the water supply device 20. By inserting the joint 24*b* into a refill-pipe holding portion 24*a* described later, the refill pipe 24 is communicated with the discharge opening 12 of the flushing water tank body 10 opposed to an opening portion 33*a* formed in an upper end portion of an overflow pipe 33 of the discharge valve device 30.

Next, the discharge valve device 30 is explained.

Into an inner peripheral surface of the discharge opening 12 formed in a center portion of the flushing water tank body 10, a discharge guide sleeve 31 which constitutes a casing of the discharge valve device 30 is fitted in a state that the discharge guide sleeve 31 is arranged upright in the flushing water tank body 10. A float holding cylinder 32 is integrally and contiguously formed with an upper portion of the discharge guide sleeve 31. An overflow pipe 33 is housed in the guide cylinder 31 and a center portion of the float holding cylinder 32 in an upwardly/downwardly movable manner. A float 34 is contiguously formed on a peripheral surface of the overflow pipe 33. Accordingly, the overflow pipe 33 is also elevated or lowered in response to a vertical movement of the float 34.

In a lower end portion of the overflow pipe 33, a discharge valve element 35 for opening and closing the discharge opening 12 is arranged in a state that the discharge valve element 35 can be brought into contact with a discharge opening valve seat 36 formed on a lower and inner peripheral surface of the discharge guide sleeve 31. Accordingly, along with the elevation of the overflow pipe 33, the discharge valve element 35 arranged on the lower end portion of the overflow pipe 33 is separated from the discharge opening valve seat 36 to start discharging of water by opening the discharge opening 12. On the other hand, Along with lowering of the overflow pipe 33, the discharge valve element 35 arranged on the lower end portion of the overflow pipe 33 is brought into contact with the discharge opening valve seat 36 to stop discharging of water by closing the discharge opening 12. That is, the discharge valve element 35 is elevated or lowered within a range above the discharge opening valve seat 36 in the discharge guide sleeve 31.

Further, in a peripheral wall of the discharge guide sleeve 31 corresponding to the elevating/lowering range of the discharge valve element 35, water introducing openings 31*a* are formed such that the water introducing openings 31*a* open in four sideward directions. In a state that the discharge opening 12 assumes a valve-opening state, that is, in a state that the discharge valve element 35 is separated from the discharge opening valve seat 36 to open the discharge opening 12, flushing water stored in the flushing water tank body 10 flows into the inside of the discharge guide sleeve 31 through the water introducing openings 31*a* and is discharged from the discharge opening 12.

In FIG. 2 and FIG. 3, numeral 37 indicates a connection stay mounted on an upper end portion of the overflow pipe 33 for transmitting buoyancy of the float 34 to the overflow pipe 33. Numeral 38 indicates a guide sleeve which is mounted upright on a center portion of an inner bottom portion of the float holding cylinder 32 for guiding the elevation or lowering of the overflow pipe 33. Numeral 39 indicates a sealing member which is interposed between a lower portion of the discharge guide sleeve 31 and the inner bottom surface 10*a* of the flushing water tank body 10. The sealing member 39 ensures the hermetic fitting of the discharge guide sleeve 31 in the discharge opening 12. Numeral 24*a* indicates a refill pipe holding portion which is mounted upright on a peripheral wall portion of the float holding cylinder 32 of the water supply device 20 for holding a refill pipe 24 above the overflow pipe 33.

Next, the leverage device 40 is explained. The leverage device 40 includes a lever 41 which has one end 41*a* thereof engaged with an upper end portion of the overflow pipe 33 of the discharge valve device 30 and brings another end thereof into contact with the push button 50, and a pedestal 42 which pivotally supports a middle portion of the lever 41.

That is, one end of the lever 41, that is, the point of action 41*a* of the leverage device opens or closes the discharge valve element 35 by way of the overflow pipe 33, and another end of the lever 41, that is, a power point 41*b* of the leverage device is brought into contact with the push button 50 arranged on a right side portion of the tank lid body 11 of the flushing water tank body 10. The lever 41 is operated by pushing the button 50. A pivotally supporting portion formed on a middle portion of the lever 41, that is, a fulcrum 41*c* of the leverage device supports the middle portion of the lever 41 on the pedestal 42.

Figure 4:
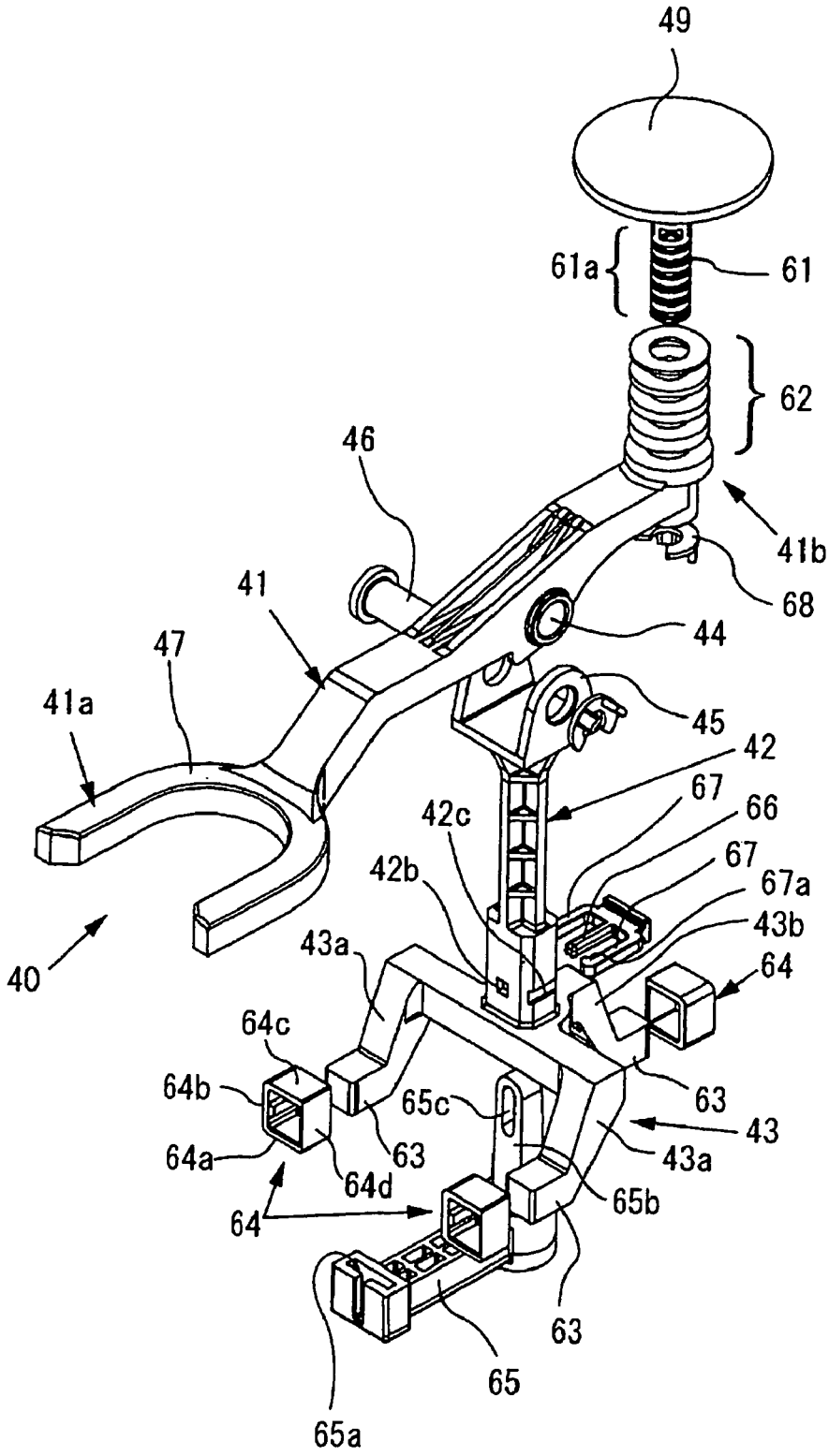
FIG. 4 is an exploded perspective view of a leverage device mounted on the toilet bowl flushing water tank device shown in FIG. 1 as viewed from a front side of the leverage device.
Figure 5:
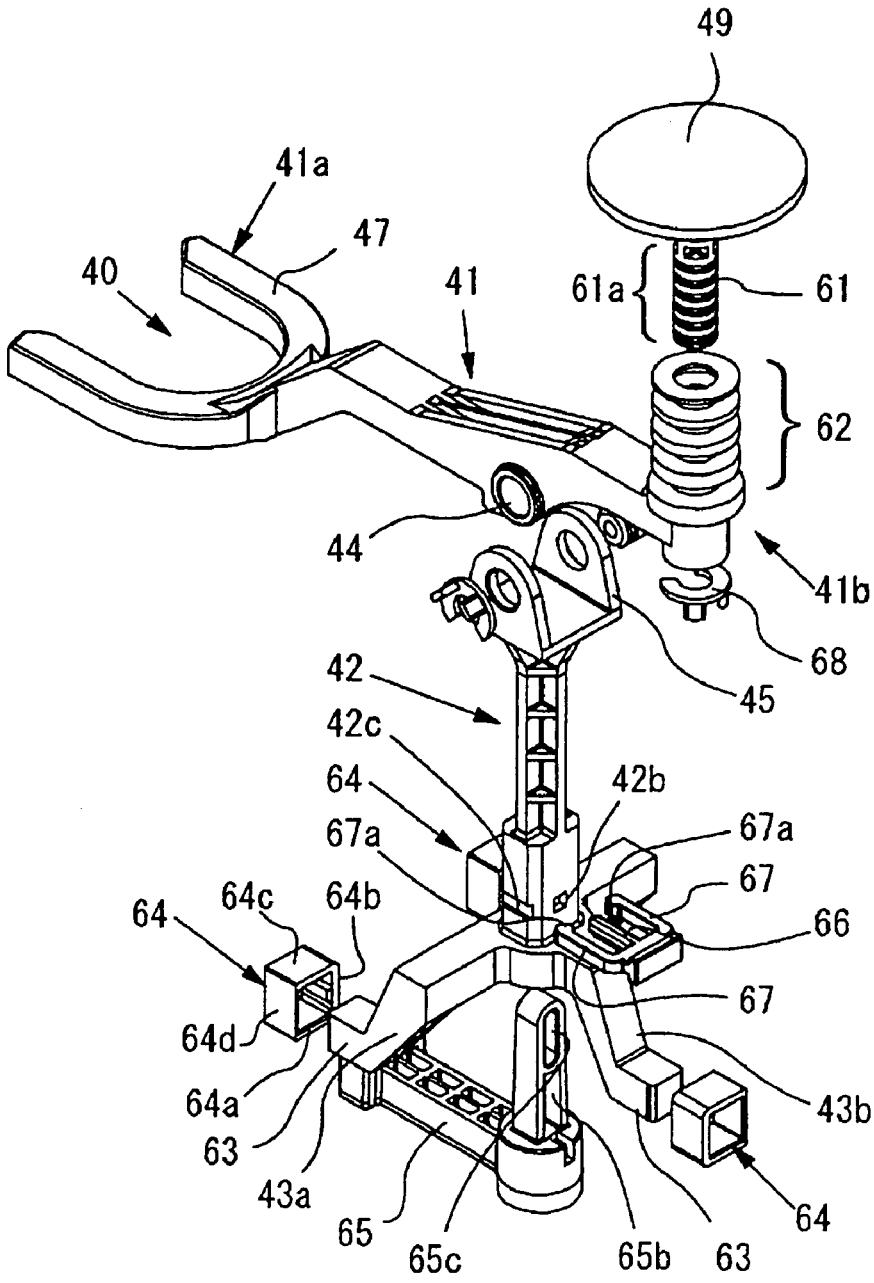
FIG. 5 is an exploded perspective view of the leverage device mounted on the toilet bowl flushing water tank device shown in FIG. 1 as viewed from a rear side of the leverage device.

FIG. 4 is an exploded perspective view of the leverage device 40 as viewed from a front side of the leverage device 40, and FIG. 5 is an exploded perspective view of the leverage device 40 as viewed from a rear side of the leverage device 40. As shown in FIG. 4 and FIG. 5, the pedestal 42 pivotally supporting the middle portion of the lever 41 includes a sphinx-pedestal-shape three-way leg body 43 constituted of left and right branch leg bodies 43*a* which are branched in the lateral direction from a lower portion of a support strut, and a center-back leg body 43*b* mounted on a rear portion of a center portion of the bifurcated portion in an extending manner. The middle portion of the lever 41 is pivotally supported on an upper end of the support strut of the pedestal 42. The left and right branch leg bodies 43*a* are arranged at a position where the left and right branch leg bodies 43*a* are brought into contact with the inner bottom surface 10*a* of the flushing water tank body 10 below the point of action 41*a* side of the lever 41, and the center-back leg body 43*b* is arranged at a position where the center-back leg body 43*b* is brought into contact with the inner bottom surface 10*a* of the flushing water tank body 10 below the power point 41*b* side of the lever 41. The three-way leg body 43 can ensure the stability of the leverage device 40 by arranging the left and right branch leg bodies 43*a* and the center-back leg body 43*b* at corresponding ground contact positions.

As described above, the leverage device 40 is arranged between the discharge valve device 30 and the push button 50 and, further, the fulcrum 41*c* constituting the pivotally supporting portion of the lever 41 is arranged at a position closer to the push button 50 side than the discharge valve device 30. Accordingly, with a small stroke of the power point 41*b* of the push button 50 generated by the leverage device operation of the lever 41, it is possible to acquire a large stroke of the point of action 41*a* in the discharge operation of the discharge valve device 30 by way of the fulcrum 41*c* at the pivotally supporting portion and hence, the flushing water discharged from the discharge opening 12 can ensure a maximum instantaneous water quantity.

Further, the fulcrum 41*c* constituting the pivotally supporting portion of the lever 41 is arranged at a position closer to the push button 50 side than the discharge valve device 30 and hence, it is possible to ensure a relatively large space between the discharge valve device 30 and the leverage device 40. Accordingly, the discharge opening 12 can have the relatively large diameter thus enhancing the discharge capacity.

Particularly by ensuring a large space between the water introducing opening 31*a* of the discharge valve device 30 and the three-way leg body 43 of the leverage device 40, it is possible to facilitate the inflow of the flushing water into the inside of the discharge guide sleeve 31 by way of the water introducing opening 31*a* on the three-way-leg-body-43 side of the leverage device 40 and hence, the discharge capacity can be further enhanced.

In the drawing, numeral 44 indicates a shaft hole formed in the middle portion of the lever 41, numeral 45 indicates upright bifurcated flanges mounted on the upper end of the pedestal 42, and numeral 46 indicates a support shaft extending between the flanges 45. The support shaft 46 is provided for pivotally supporting the lever 41 between the bifurcated flanges 45 arranged on the upper end of the pedestal 42 by way of the shaft hole 44 formed in the lever 41.

On one end (point of action 41*a*) of the lever 41 arranged on a side of the overflow pipe 33, a bifurcated fork portion 47 is formed, and an upper-end arm portion (not shown in the drawing) of the overflow pipe 33 is clamped between bifurcated portions of the fork portion 47. On the other hand, a vertically-extending insertional hole 48 is formed in the other end (power point 41*b*) of the lever 41 the push button 50, and a lever receiving disc 49 constituting a disc-like lever receiving portion is arranged above an upper end of the insertional hole 48. A support strut 61 is mounted on a lower surface of the lever receiving disc 49 in a downwardly extending manner. The other end (power point 41*b*) of the lever 41 and the lever receiving disc 49 are fixed to each other by latching the support strut 61 at an arbitrary position of a circumferential groove 61*a* formed in a lower portion of the support strut 61 using a retainer ring 68 in a state that the support strut 61 is inserted into the insertional hole 48.

A large number of adjusting washers 62 are removably mounted on a peripheral surface of the support strut 61. By interposing the adjusting washers 62 between an upper end surface of the opening of the insertional hole 48 and the lever receiving disc 49, a vertical mounting position of the lever receiving disc 49 relative to the lever 41 can be adjusted. In this manner, by adjusting the vertical mounting position of the lever receiving disc 49 relative to the lever 41, a relative positional relationship between the push button 50 and the lever receiving disc 49 is adjusted thus adjusting timing for bringing the push button 50 into contact with the lever receiving disc 49.

Further, a lower end portion of the three-way leg body 43 is formed of mounting portions 63 each of which has a rectangular cross section in conformity with the inner bottom surface 10*a* of the flushing water tank body 10. Each mounting portion 63 is provided with a height adjusting mechanism. The height adjusting mechanism is constituted of an adjusting block 64 formed in a shape which allows the detachable fitting of the adjusting block 64 on the rectangular-cross-sectional mounting portion 63. That is, the adjusting block 64 is formed in a hollow rectangular frame shape. Respective four side walls 64*a*, 64*b*, 64*c* and 64*d* of the hollow rectangular frame of the adjusting block 64 are configured to have wall thicknesses different from each other. Accordingly, in fitting the adjusting block 64 on the mounting portion 63, by selecting any one of thicknesses of four side walls 64*a*, 64*b*, 64*c*, 64*d* as the thickness of the sidewall to be positioned on a lower surface side, it is possible to adjust a gap between the mounting portion 63 and the inner bottom surface 10*a* of the flushing water tank body 10. Eventually, by adjusting gaps between the respective leg bodies 43*a*, 43*b* of the three-way leg body 43 and the non-uniform inner bottom surface 10*a*, it is possible to adjust the height balance among the respective leg bodies of the three-way leg body 43 for absorbing a play and, at the same time, it is possible to make the fine adjustment of the overall height of the pedestal 42.

Further, a pedestal stay 65 is interposed between the discharge guide sleeve 31 of the discharge valve device 30 and the leverage device 40. The pedestal stay 65 is configured to connect a lower portion of the discharge guide sleeve 31 of the discharge valve device 30 and a lower portion of the pedestal 42 of the leverage device 40 to each other and, at the same time, to maintain a distance between the discharge guide sleeve 31 and the leverage device 40 at a fixed distance. That is, an insertional hole 42*a* which allows the insertion of the support shaft 65*b* therein from below is formed in a lower end of the pedestal 42, that is, a lower end of the support strut. On the other hand, a fitting hole 65*a* is formed in one end of the pedestal stay 65, and a protrusion 31*b* formed on a side wall of a lower portion of the discharge guide sleeve 31 is detachably fitted in the fitting hole 65*a*. On the other end of the pedestal stay 65, a support shaft 65*b* is mounted upright. The support shaft 65*b* is detachably fitted in the insertional hole 42*a* formed in a lower end of the pedestal 42, that is, a lower end of the support strut of the pedestal 42. The support shaft 65*b* forms an upper end thereof into an inverted U-shaped strip-shaped body, and the strip-shaped body is formed in a tapered shape such that a width of the strip-shaped body is gradually decreased toward an upper end thereof. By forming the support shaft 65*b* in the above-mentioned tapered shape, the support shaft 65*b* is fitted in the insertional hole 42*a* with a predetermined gap between the support shaft 65*b* and an inner peripheral surface of the insertional hole 42*a*. The gap is formed for absorbing an inclination of the pedestal stay 65 which occurs in performing vertical-position setting of the pedestal 42.

Further, the insertional hole 42*a* for allowing the insertion of the support shaft 65*b* therein from below is formed in the lower end of the pedestal 42, that is, the lower end of the support strut.

Due to such a constitution, for interposing the pedestal stay 65 between the discharge valve device 30 and the leverage device 40, first of all, the protrusion 31*b* of the discharge guide sleeve 31 of the discharge valve device 30 is connected to one end of the pedestal stay 65 by allowing the protrusion 31*b* to be fitted into one end of the pedestal stay 65 and, at the same time, the support shaft 65*b* mounted on the other end of the pedestal stay 65 is inserted into the insertional hole 42*a* formed in the lower end of the pedestal 42 thus interposing the pedestal stay 65 between the discharge valve device 30 and the leverage device 40. A lateral hole 42*b* is formed in a lower-portion side wall of the pedestal 42, and a pin 66 which is separately prepared is inserted into the lateral hole 42*b*, and the pin 66 is made to be engaged with the elongated engaging hole portion 65*c* formed in the support shaft 65*b* which is preliminarily loosely fitted into the insertional hole 42*a* of the pedestal 42 thus preventing the removal of the support shaft 65*b* mounted upright on the pedestal stay 65. while preventing the removal of the support shaft 65*b*, by forming the engaging hole portion 65*c* in a elongated shape, the support shaft 65*b* is fitted in and fixed to the insertional hole 42*a* in a state that the support shaft 65*b* is vertically movable within a predetermined distance, that is, is tiltable within a hole width of the engaging hole portion 65*c*. Due to such a constitution, the support shaft 65*b* is fitted in and fixed to the insertional hole 42*a* and hence, it is possible to absorb an error in the vertical direction generated along with the setting of the pedestal 42 in the vertical direction.

In the drawing, numeral 67 indicates engaging pins which are joined to both sides of a proximal portion of the pin 66 in a state that the engaging pins 67 are arranged in parallel to the pin 66, and a distal end of each engaging pin 67 is formed into an engaging projection 67*a* by bulging. When the pin 66 is inserted in the lateral hole 42*b*, the engaging pins 67 arranged on both sides of the pin 66 are fitted in the groove portions 42*c* formed in both side walls of the pedestal 42, and the engaging projections 67*a* are engaged with the side walls of the pedestal 42 on a depth side of the groove portions 42*c* thus performing the insertion and fixing of the pin 66.

Next, the push button 50 which is interlockingly connected with the leverage device 40 is explained.

As shown in FIG. 1 to FIG. 3, as described above, the push button 50 is arranged on a right side portion of the tank lid body 11 of the flushing water tank body 10, that is, at the position offset from the position where the discharge opening 12 is formed. A push button insertional hole 51 is formed in the tank lid body 11. A bottomed cylindrical push button casing 52*a* forming an engaging flange 52 on an upper end thereof is mounted in the hole 51 in a downwardly extending manner, A nut 53 is threadedly engaged with male threads formed on a peripheral surface of the push button casing 52*a* so as to hermetically fix the above-mentioned engaging flange 52 to the tank lid body 11. A push button body 54 is inserted in the casing 52*a*, and a spring 55 is interposed between the button body 54 and an inner bottom surface of the push button casing 52*a*. A plunger 56 is mounted on a lower surface of the push button body 54 in a downwardly extending manner, a contact member 57 is mounted on a lower end portion of the plunger 56, and the contact member 57 can be in contact or separated from the lever receiving disc 49 mounted on one end of the lever 41 of the leverage device 40.

[Explanation of manner operation]

As shown in FIG. 2, in a state that the discharge opening 12 is closed, that is, in a state that the discharge valve element 35 is seated on the discharge opening valve seat 36 of the discharge guide sleeve 31, the lever 41 of the leverage device 40 is in contact with the contact member 57 of the push button body 54, and flushing water is filled with flushing water tank body 10 up to a predetermined position.

When the push button body 54 is pushed in such a state, the contact member 57 pushes the lever receiving disc 49 downwardly and, as shown in FIG. 3, the lever 41 of the leverage device 40 assumes an inclined state where the left end of the lever 41 is lifted about the pivotally supporting portion 41*c*. The bifurcated fork portion 47 mounted on one end of the lever 41 pulls up the overflow pipe 33 while being engaged with the peripheral wall of the overflow pipe 33. Simultaneously with such pulling up of the overflow pipe 33, the float 34 is also risen up. Further, the discharge valve element 35 mounted on a lower end of the overflow pipe 33 is also pulled up in the discharge guide sleeve 31. Due to such operations, flushing water is discharged toward the discharge opening 12 from the predetermined water introducing openings formed in the peripheral wall of the discharge guide sleeve 31.

Here, although the pushed push button body 54 returns to an original position due to the spring 55, the overflow pipe 33 which brings about a temporary discharging state by opening the discharge valve element 35 is kept in a lifted state due to the buoyancy of the float 34. The float 34 keeps on lowering until the float 34 approaches the dead-water-line position along with discharging of water. Along with the lowering of the float 34, the lever 41 also approaches a lever position which makes the discharge opening 12 assumes a closed state. When the valve element 35 closes the discharge opening 12, the lever 41 returns to a position before the discharging is started where the tank is filled with flushing water (see FIG. 2).

As described above, in performing the opening/closing operation of the discharge valve element 35 by way of the overflow pipe 33 by rotating the lever 41 about the pivotally supporting portion 41*c* with a pushing operation of the push button 50, since the pivotally supporting portion 41*c* of the lever 41 is arranged at a position closer to the push button 50 side than the discharge valve device 30, eventually, the distance between the pivotally supporting portion 41*c* of the lever 41 and the point of action 41*a* in leverage device of the lever 41 is set larger that the distance between the pivotally supporting portion 41*c* of the lever 41 and the power point 41*b* of the lever 41. Accordingly, it is possible to acquire advantageous effects that one end of the lever as the point of action 41*a* can be largely operated with a small pushing-down quantity (stroke) of the push button 50 thus lifting the overflow pipe 33 at a stroke whereby it is possible to largely open the discharge valve element 35 instantaneously and, at the same time, it is possible to ensure a relatively large space in the vicinity of the discharge valve device 30 and hence, a diameter of the discharge opening 12 can be made relatively large thus enhancing the discharge capacity.

With respect to the advantageous effects described in the embodiment of the present invention, the advantageous effects obtained by the present invention which are considered most favorable are merely enumerated. Accordingly, the advantageous effects acquired by the present invention are not limited to such advantageous effects described in the above-mentioned embodiment.

What is claimed is:

1. A toilet bowl flushing water tank device comprising:

a flushing water tank body forming a discharge opening in a center portion of the flushing water tank body;

a discharge valve device for vertically moving a discharge valve element relative to the discharge opening, the discharge valve device being mounted and housed in the flushing water tank body;

a leverage device interlockingly connected to the discharge valve device, the leverage device being mounted and housed in the flushing water tank body; and a push button interlockingly connected to the leverage device in the flushing water tank body, the push button being mounted on a tank lid body of the flushing water tank body, wherein the push button is arranged at a position offset to one side from a position where the discharge opening is formed, the leverage device is constituted of a lever which is interlockingly connected to the discharge valve element and a pedestal which pivotally supports a middle portion of the lever, the pedestal pivotally supports a middle portion of the lever at a position closer to a push button side than to the discharge valve device, a height adjusting mechanism is arranged below the pedestal of the leverage device, a leg body is contiguously mounted on a lower end of the pedestal of the leverage device, and the height adjusting mechanism is constituted of an adjusting block which is detachably mounted on the leg body for adjusting a distance between a ground contact surface of the leg body and an inner bottom surface of the flushing water tank body.

2. A toilet bowl flushing water tank device according to claim 1, wherein the leg body is constituted of a three-way leg body constituted of left and right branch leg bodies and a center-back leg body.

3. A toilet bowl flushing water tank device according to claim 1, wherein a lever receiving portion which receives a pushing action of the push button is formed on the lever of the leverage device and the lever receiving portion is configured such that a vertical mounting position of the lever receiving portion is adjustable relative to the lever by way of an adjusting washer.

4. A toilet bowl flushing water tank device according to claim 1, wherein a pedestal stay for connecting a lower portion of a casing of the discharge valve device and a lower portion of the pedestal of the leverage device has a first end configured to be detachably fitted in the lower portion of the casing and has a second end provided with an upright support shaft fitted in an insertional hole formed in a lower end of the pedestal, the support shaft being fitted in and fixed to the insertional hole in a tiltable manner by a predetermined length in the vertical direction.

5. A toilet bowl flushing water tank device according to claim 1, wherein a pedestal stay for connecting a lower portion of a casing of the discharge valve device and a lower portion of the pedestal of the leverage device has a first end configured to be detachably fitted in the lower portion of the casing and has a second end provided with an upright support shaft fitted in an insertional hole formed in a lower end of the pedestal, the support shaft being loosely fitted in the insertional hole with a predetermined gap between the support shaft and an inner peripheral surface of the insertional hole.

6. A toilet bowl flushing water tank device according to claim 1, wherein four side walls of a hollow rectangular frame of the adjusting block are configured to have wall thicknesses different from each other and, when fitting the adjusting block on the leg body, a gap between the leg body and the inner bottom surface of the flushing water tank body is adjustable by selecting one of the thicknesses of the four side walls as a thickness of a sidewall to be positioned on a lower surface side.

7. A toilet bowl flushing water tank device comprising:

a flushing water tank body defining a bottom surface and a center portion, the flushing water tank body forming a discharge opening in the center portion;

a discharge valve device for vertically moving a discharge valve element relative to the discharge opening, the discharge valve device being mounted and housed in the flushing water tank body;

a leverage device interlockingly connected to the discharge valve device, the leverage device being mounted and housed in the flushing water tank body; and a push button interlockingly connected to the leverage device in the flushing water tank body, the push button being mounted on a tank lid body of the flushing water tank body, wherein the push button is arranged at a position offset to one side from a position where the discharge opening is formed, the leverage device is constituted of a lever which is interlockingly connected to the discharge valve element and a pedestal which pivotally supports a middle portion of the lever, the pedestal pivotally supports a middle portion of the lever at a position closer to a push button side than to the discharge valve device, and a pedestal stay for connecting a lower portion of a casing of the discharge valve device and a lower portion of the pedestal of the leverage device contacts the bottom surface of the flushing water tank body and has a first end configured to be detachably fitted in the lower portion of the casing and has a second end provided with an upright support shaft fitted in an insertional hole formed in a lower end of the pedestal, the support shaft being fitted in and fixed to the insertional hole in a tiltable manner by a predetermined length in the vertical direction.

8. A toilet bowl flushing water tank device comprising:

a flushing water tank body defining a bottom surface and a center portion, the flushing water tank body forming a discharge opening in the center portion;

a discharge valve device for vertically moving a discharge valve element relative to the discharge opening, the discharge valve device being mounted and housed in the flushing water tank body;

a leverage device interlockingly connected to the discharge valve device, the leverage device being mounted and housed in the flushing water tank body; and a push button interlockingly connected to the leverage device in the flushing water tank body, the push button being mounted on a tank lid body of the flushing water tank body, wherein the push button is arranged at a position offset to one side from a position where the discharge opening is formed, the leverage device is constituted of a lever which is interlockingly connected to the discharge valve element and a pedestal which pivotally supports a middle portion of the lever, the pedestal pivotally supports a middle portion of the lever at a position closer to a push button side than to the discharge valve device, and a pedestal stay for connecting a lower portion of a casing of the discharge valve device and a lower portion of the pedestal of the leverage device contacts the bottom surface of the flushing water tank body and has a first end configured to be detachably fitted in the lower portion of the casing and has a second end provided with an upright support shaft fitted in an insertional hole formed in a lower end of the pedestal, the support shaft being loosely fitted in the insertional hole with a predetermined gap between the support shaft and an inner peripheral surface of the insertional hole.

* * * * *